United States Patent [19]

Yamaguchi

[11] 4,093,408

[45] June 6, 1978

[54] POSITIVE CAM TYPE COMPRESSOR

[76] Inventor: Yoshichika Yamaguchi, 101 Toyobafuji, Toyoyama-Chou, Nishikasugai-District, Aichi Prefecture, Japan

[21] Appl. No.: 747,086

[22] Filed: Dec. 3, 1976

[51] Int. Cl.[2] ..... F01C 1/00; F01C 19/00; F01C 21/04

[52] U.S. Cl. ..... 418/92; 418/139; 418/216

[58] Field of Search ..... 418/92, 216, 219, 139

[56] References Cited

U.S. PATENT DOCUMENTS

| | | | |
|---|---|---|---|
| Re. 24,975 | 4/1961 | Wallimann | 418/92 |
| 805,140 | 11/1905 | Jarvis | 418/216 |
| 827,870 | 8/1906 | Jarvis | 418/216 |
| 848,446 | 3/1907 | Crowell | 418/92 |
| 1,114,046 | 10/1914 | Roessler | 418/92 |
| 2,948,230 | 8/1960 | Shelton | 418/216 |

*Primary Examiner*—John J. Vrablik

*Attorney, Agent, or Firm*—Haseltine, Lake & Waters

[57] ABSTRACT

A rotary compressor, more particularly, a positive cam type compressor wherein a movable isolator plate is driven by a positive cam. The positive cam has a helically twisted disk portion, and is fitted in a cylinder slidably. The cylinder cavity is divided into operating compartments in which suction and compression processes are performed alternately, when the positive cam is rotated by a driver shaft. The positive cam and the isolator plate form a sliding pair, so that the plate can be reciprocatively moved when the cam rotates. The circulation of lubricating oil is positively effected by the reciprocating motion of the isolator plate.

Thus, there can be provided a considerably small and light compressor that is constructed with relatively smaller number of parts. Furthermore, the compressor of the present invention may have good characteristics of vibration and noise. The above compressor is suitable to an air conditioner for vehicle.

5 Claims, 21 Drawing Figures

POSITIVE CAM TYPE COMPRESSOR

FIELD OF THE INVENTION

This invention relates to a positive cam type rotary compressor wherein a positive cam makes a movable isolator plate reciprocate so as to circulate lubricating oil. The compressor may be generally utilized in an air-conditioner for a car.

BACKGROUND

Recently, it is required to lessen car accessories such as a compressor for a car air-conditioner as regards size and weight, because the receiving space and total weight of the car accessories are extremely restricted in order to increase the efficiency of the car. A swash plate type compressor is highly valued, as it is more efficient than a reciprocating type compressor, and it only generates very little noise and vibration. But, it is difficult to lessen the number of parts and the size and weight of the said swash plate type compressor due to its peculiar construction. On the other hand, the reciprocating compressor is inferior in characteristics of vibration and noise, and has constructional deficiencies similar to that of the swash plate type compressor.

SUMMARY OF THE INVENTION

It is an object of the present invention to provide a compressor of novel type that is small and light, and can be constructed with relatively few parts.

Another object is to provide a compressor of high efficiency which only generates a very slight noise and vibration.

Numerous other objects and advantages of the present invention will become readily apparent from the following detailed description taken in conjunction with the accompanying drawings which show the preferred embodiment.

DETAILED DESCRIPTION

Figure 1:
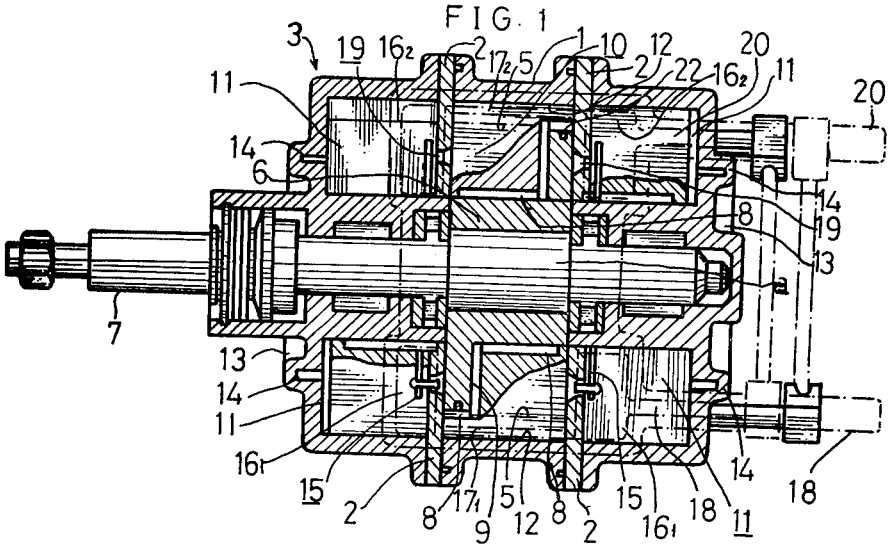
FIG. 1 is a horizontal sectional view of a positive cam type compressor.
Figure 5:
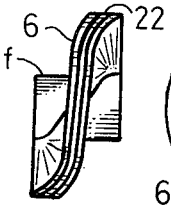
FIG. 5 is a right side view of a positive cam.
Figure 6:
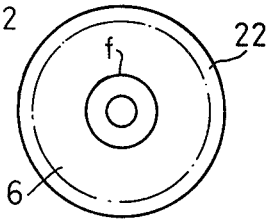
FIG. 6 is a front view of the positive cam of FIG. 5.
Figure 7:
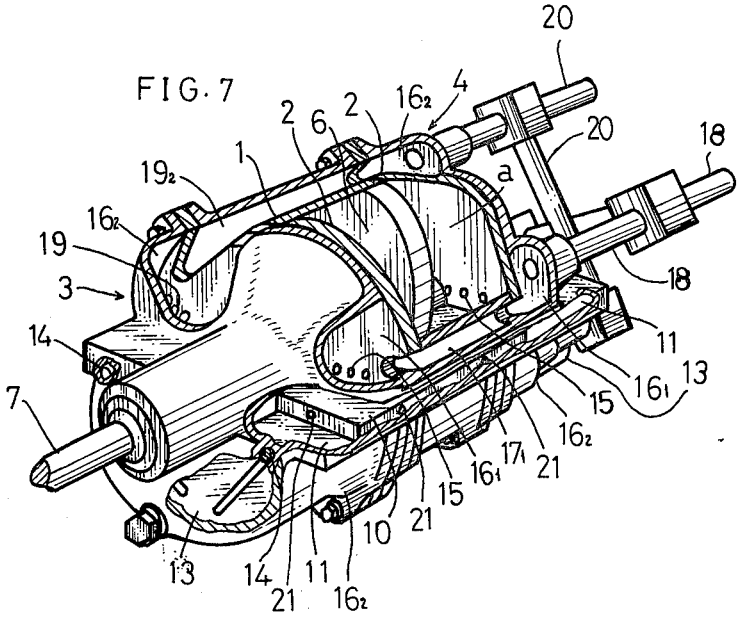
FIG. 7 is a perspective view of the compressor of FIG. 1 with some portions being cut out.
Figure 20:
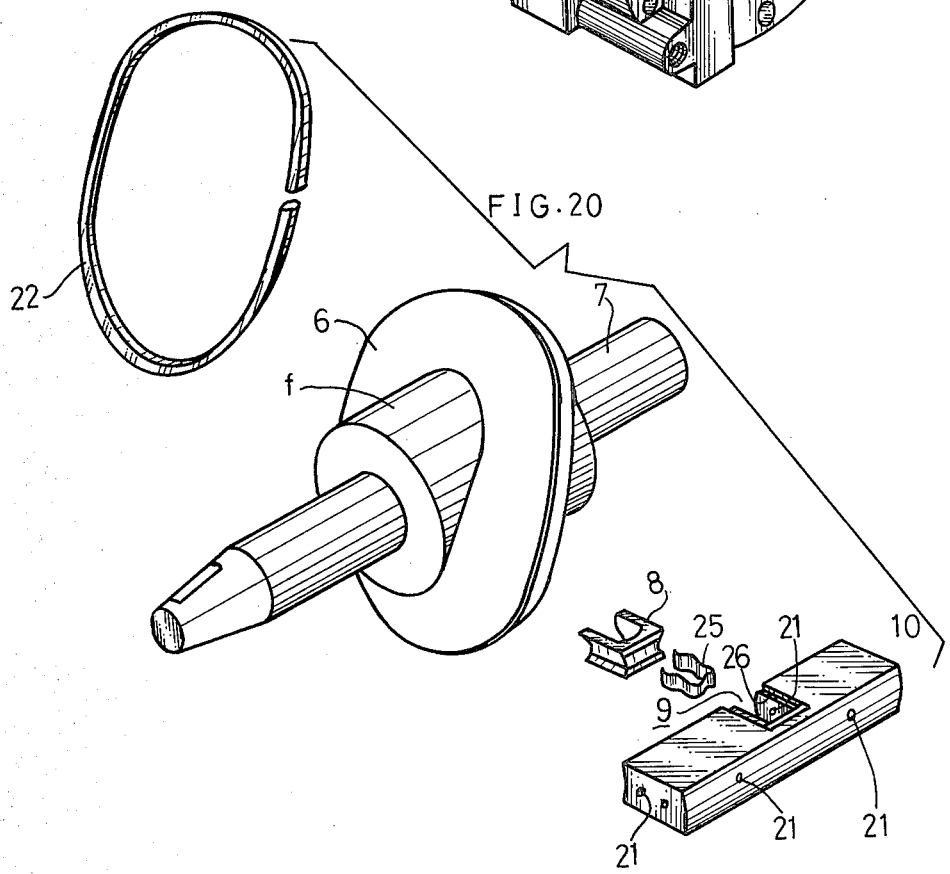
FIGS. 18 to 21 are perspective views of parts of the compressor of FIG. 17.

Referring to FIGS. 1 and 7, a cylinder block 1 of cylindrical shape is provided with a front housing 3 and a rear housing 4 at each end. One valve plate 2 is interposed between the cylinder block 1 and the front housing 3. The rear housing is closed to the cylinder block 1 by another valve plate 2. A positive cam 6 is fixed to a drive shaft 7 arranged at the center of a cylinder 5. The cylinder 5 is closed at each end by said valve plates 2. The positive cam 6 is composed of a cylindrical central portion *f* and a helical disk portion. The driver shaft 7 passes through the central portion *f* coaxially. The helical disk portion is twisted as shown in FIG. 5, and slidably fitted in a slide groove 9 of a movable isolator plate 10. The positive cam 6 is provided with a seal ring 22 on its periphery as shown in FIGS. 5, 6 and 20. The positive cam 6 and the isolator plate 10 are in sliding relation with one another, so that the isolator plate 10 can be reciprocated along the axis of the cylinder 5 by the positive cam 6 when it rotates in the cylinder cavity, contacting the inner faces of cylinder 5 and the valve plates. The sealing effect between cam 6 and isolator plate 10 is assured by seal member 8.

Figure 10:
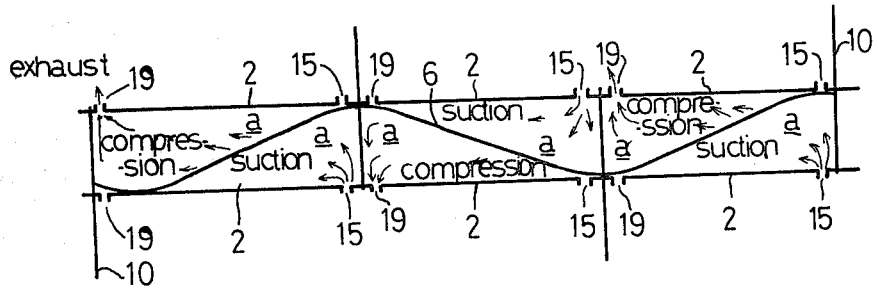
FIG. 10 is a functional diagram of the compressor showing how the suction and compression processes are repeated.

The movable isolator plate defines single or plural operating compartments 8 in the cylinder 5. In the present embodiment, the cylinder cavity is divided into two equal compartments a by two isolator plates 10 disposed diametrically. Accordingly, suction and compression stages are repeated in each operating compartment a as shown in FIG. 10, when the positive cam 6 is rotated by the driver shaft 7. The outer edge portions of isolator plates 10 are slidably fitted into guide grooves 12, which are formed on the opposite inner faces of cylinder 5.

Figure 18:
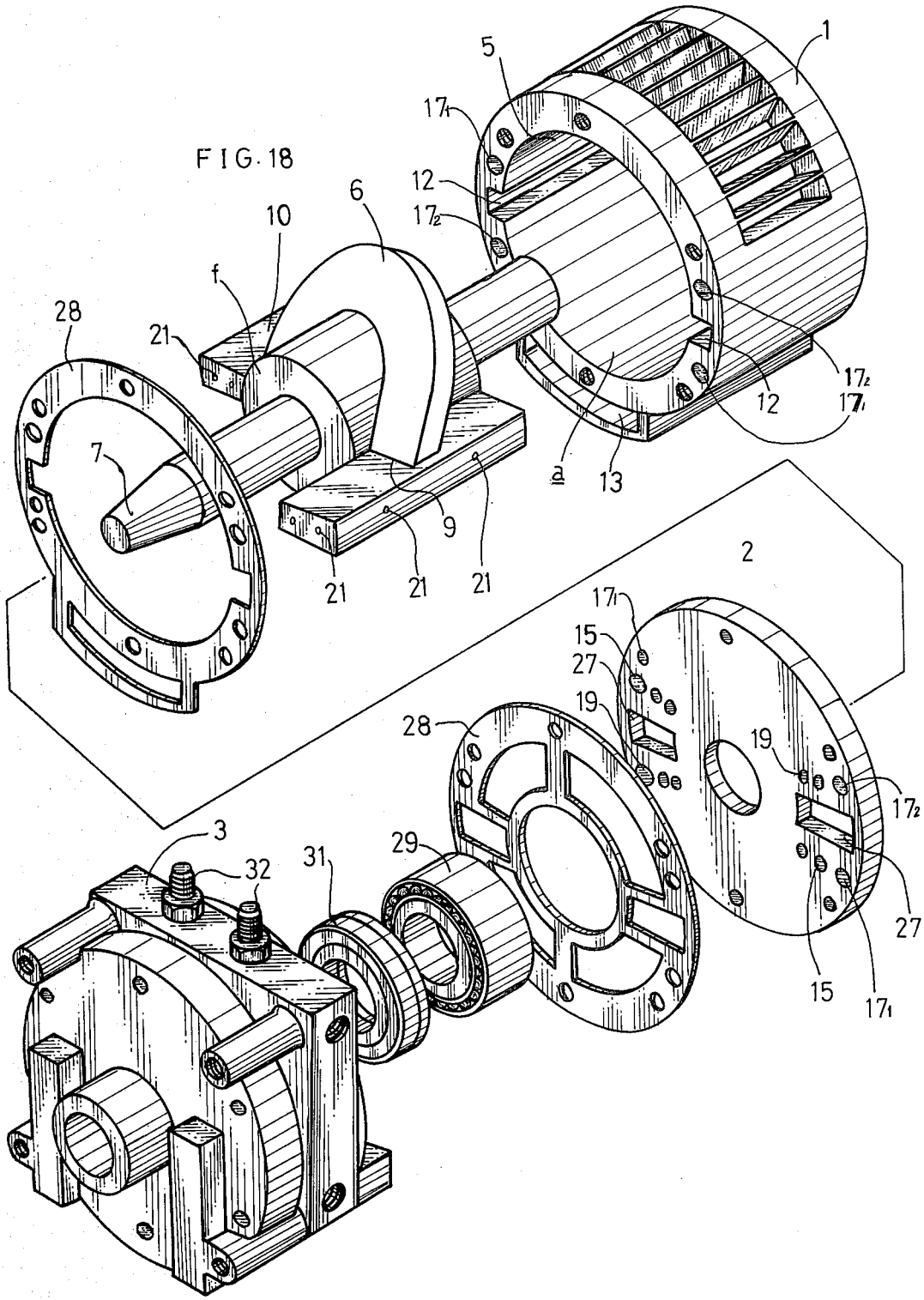
Figure 19:
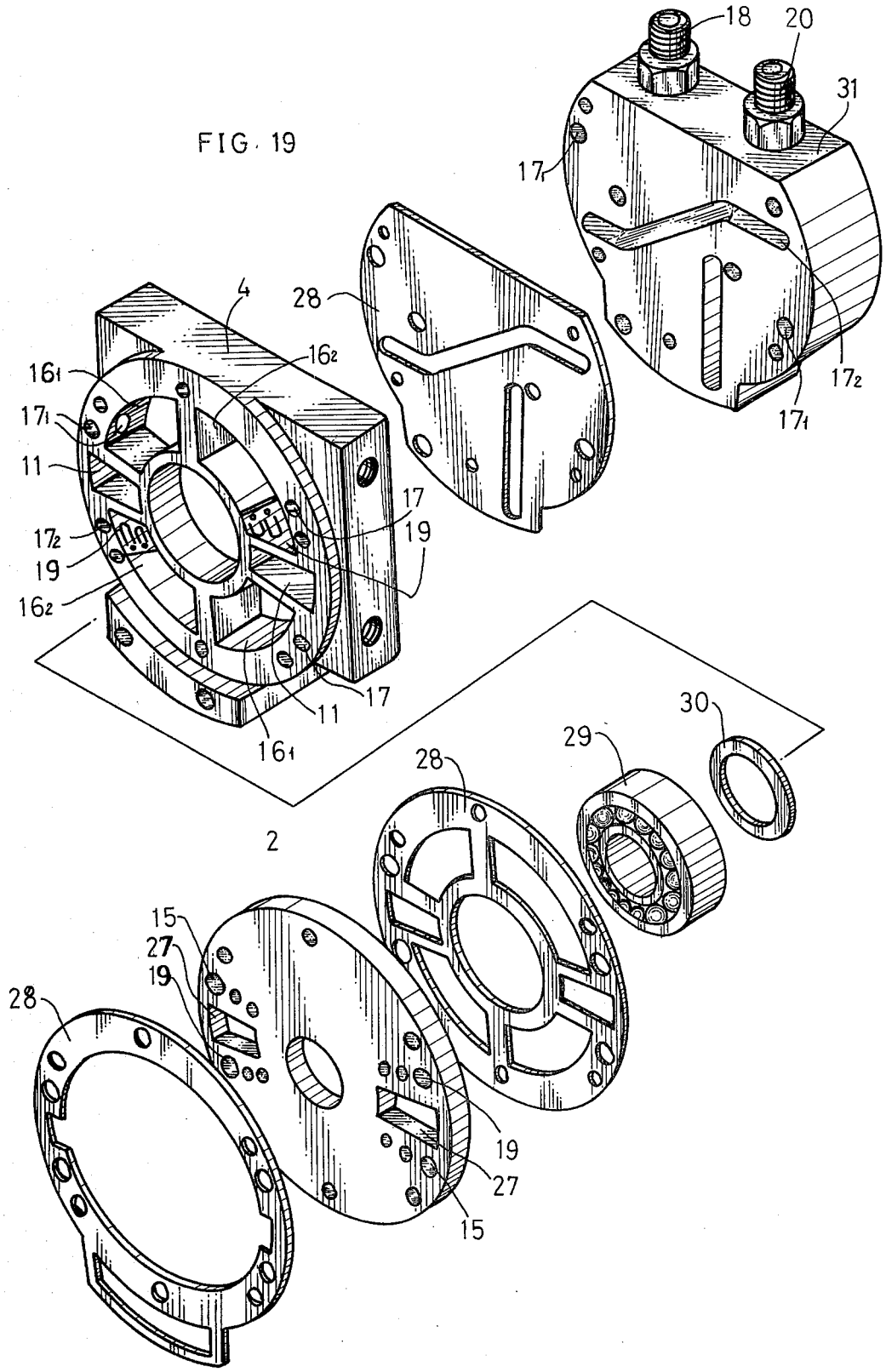
Figure 21:
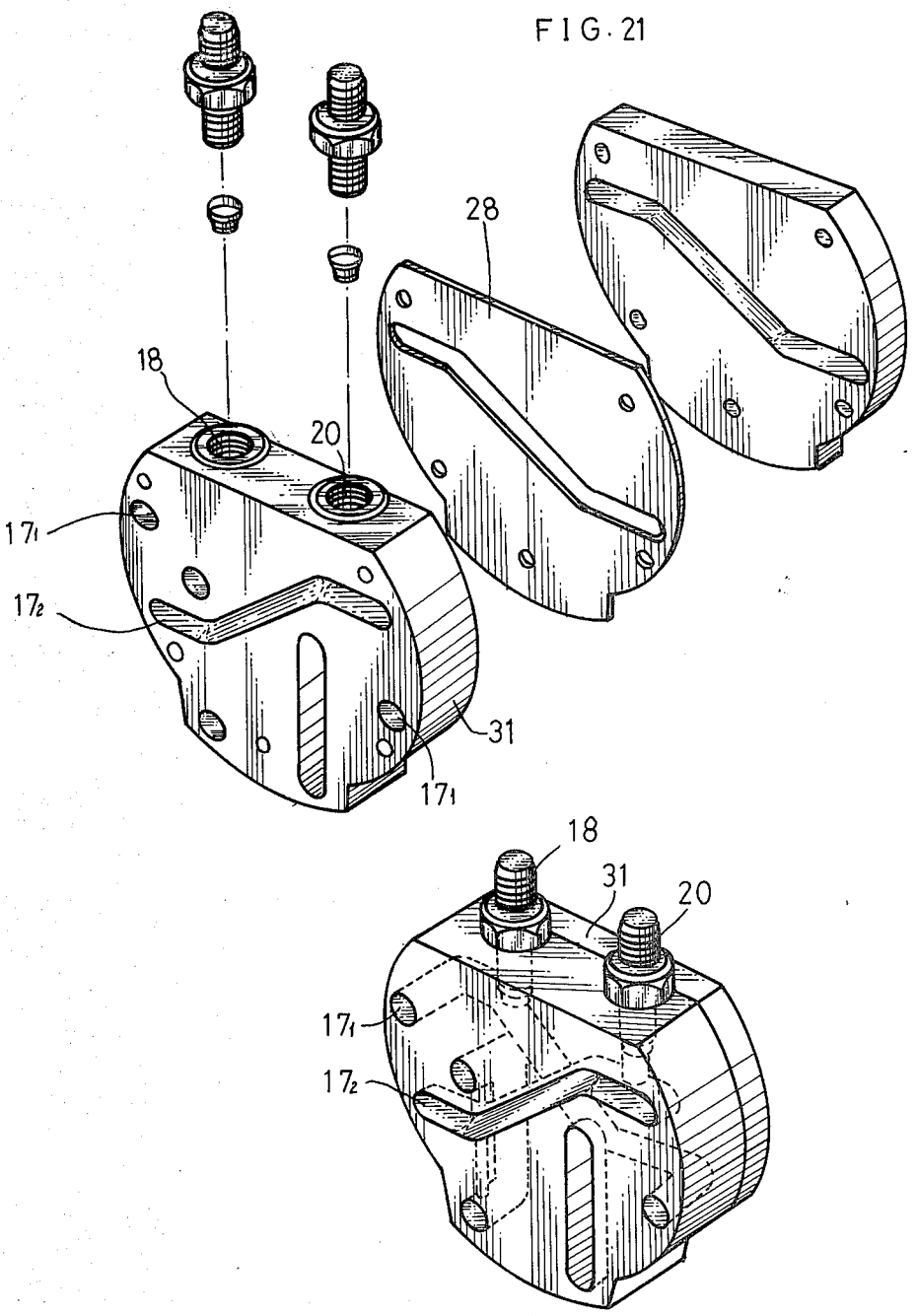

Both the front housing 3 and the rear housing 4 have two plate casings 11, which communicate with the guide grooves 12 and angular guide holes 27 shown in FIGS. 18 and 19. Each end portion of isolator plate 10 can enter the casing 11 of front housing 3 and that of rear housing 4 alternately through said guide holes 27 of valve plates 2, when it moves reciprocatively. Each plate casing 11 communicates with a lubricating oil tank 13 of the housing via oil feeding hole 14. Valve plate 2 has at least one suction valve 15 at one edge of the guide hole, and at least one exhaust valve 19 at the other edge of the guide hole 27. As there are two guide holes, there are two pairs of valves 15 and 19.

The front housing 3 has two charge chambers $16_1$ with which the suction valve 15 communicates, and two discharge chambers $16_2$ with which the exhaust valve 19 communicates. A suction pipe 18 is connected to the charge chamber $16_1$ with an inlet passage $17_1$, and the discharge chamber $16_2$ is connected to an exhaust pipe 20 by an outlet passage $17_2$. Also, the rear housing 4 is provided with the same chambers $16_1$ and $16_2$.

Figure 2:
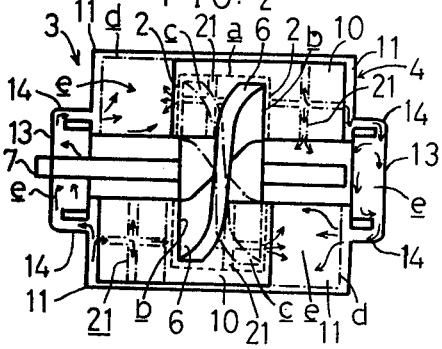
FIG. 2 is a simplified diagram of the compressor showing the flow of lubricating oil.
Figure 3:
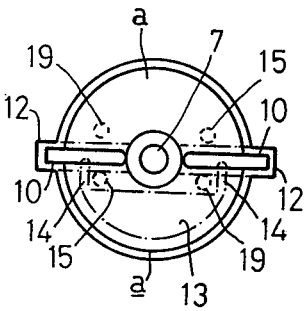
FIG. 3 is a simplified diagram of the compressor showing the relation between a movable isolator plate and valves.
Figure 4:
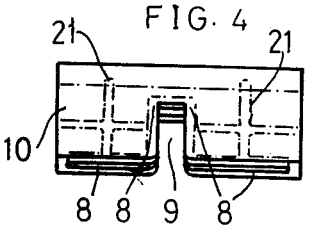
FIG. 4 is a perspective view of the isolator plate.

Referring to FIGS. 2, 3 and 4, when the positive cam 6 rotates throughout the angle of 360°, the contact portion *b* of positive cam 6 moves to the position *c*, and the movable isolator plate 10 moves to the position *d*. Each isolator plate 10 can act as a plunger in the plate casing 11. When the isolator plate 10 enters the casing 11, it positively pushes the lubricating oil e stored in the casing. A requisite quantity of the compressed oil is fed to the seal member 8 that contacts the positive cam 6, and to all other portions that contact the cylinder wall, the guide groove 12 or the valve plate 2. This oil feeding is performed by way of a network of oil channels 21 that is formed in the isolator plate 10.

When the cam 6 rotates once again through the angle of 360°, the plate 10 can return to the first position. Thus, when the isolator plate 10 gets out of the casing 11, an adequate sucking phenomenon occurs, so that the lubricating oil e can be withdrawn from the above portions to the casing 11 and/or the oil tank 13. The circulation of lubricating oil depends upon the pumping action, which is caused by the fact that the oil tank 13 communicates with the plate casing 11 by the oil feeding hole 14 of narrow diameter.

Figure 8:
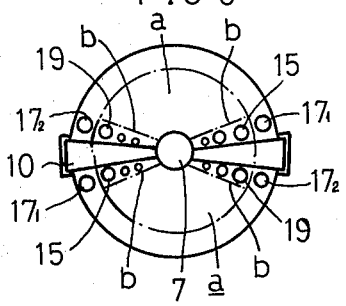
FIG. 8 is a simplified diagram of the compressor showing figures of the isolator plate and valves.
Figure 9:
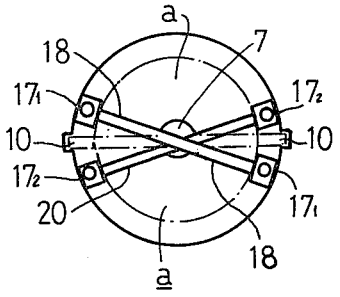
FIG. 9 is a simplified diagram of the compressor showing the arrangement of isolator and passages.

Referring to FIGS. 8 and 9, both the suction valve 15 and the exhaust valve 19 should be disposed in the proximity of the movable isolator plate 10 in sequence of suction and exhaust. There are two sets of suction valves 15, and also two sets of exhaust valves 19. Each set is composed of three valves which are arranged in a line. The suction and exhaust operations can be performed very smoothly, giving adequate consideration to the opening area of the valve, and to the cross section of isolator plate 10. Namely, valve holes of suction valve 15 and exhaust valve 19 should be made in several sizes correspondingly to the shape of the contacting portion *b* of cam 6. And the isolator plate 10 should have a sectorial section so as to match the contacting portion *b*.

Figure 11:
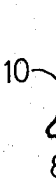
FIGS. 11 to 14 are sectional views of movable isolator plates of modified forms.
Figure 12:
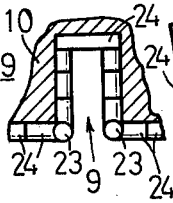
Figure 13:
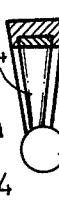
Figure 14:
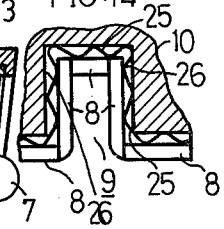
Figure 15:
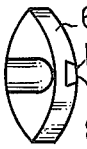
FIG. 15 is a front view of a positive cam of another form.
Figure 16:
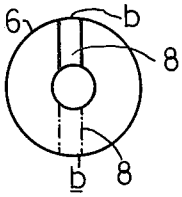
FIG. 16 is a top plan view of the cam of FIG. 15.
Figure 17:
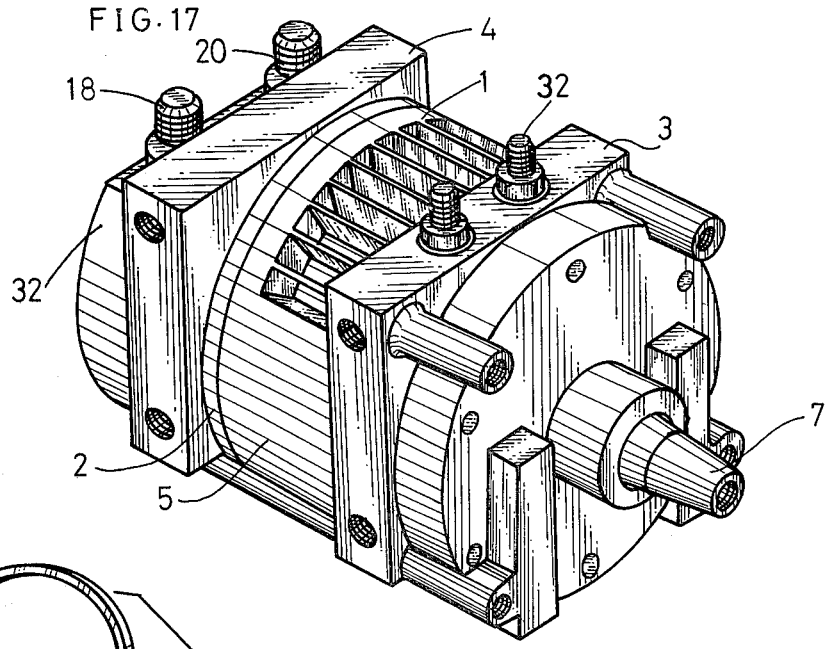
FIG. 17 is a perspective view of a positive cam type of another embodiment of the present invention.

In order to ensure smooth motions of cam 6 and plate 10, all contact portions of seal member 8 are preferably rounded, and a ball 23 is fitted in the corner of seal member 8 as shown in FIGS. 11 and 12. In FIG. 12, a roll 24 is used as a seal element. In FIG. 13, there is used a tapered roll 24 of arched cross section. In FIGS. 14 and 20, seal members 8 are fitted in a groove 26, and supported by a waved spring 25. Corners g of the seal members 8 of FIG. 14 are rounded. In FIG. 16, the portion b that contacts the valve plate 2 is provided with a seal member 8 or suitable anti-friction material. These structures are designed to smooth the motions of cam 6 and plate 10. In FIGS. 18 and 19, numerals 28 and 29 designate a gasket and a bearing, respectively. The numeral 31 designates a rear block having an oil-gas separator of mesh type. In this embodiment, lead valves are used as exhaust valves 19, and lubricating oil tank is disposed at the lower portion of cylinder block 1. Numerals 30 and 32 designate a seal ring and service valve, respectively.

According to the present invention, there can be obtained a relatively small and light compressor adapted for use with a car air conditioner. Furthermore, it is possible to greatly decrease the number of parts of the compressor. Also, the positive cam type compressor of the present invention is superior in characteristics of vibration and noise. It should be understood that the pulsation of the exhaust pressure can be adequately diminished by changing the number of movable isolator plates. The use of the present compressor is not restricted to a vehicle. The construction of the invention can be utilized in making an industrial compressor of large capacity. Furthermore, the substance to be compressed is not limited to a refrigerant or cooling medium. The present invention can be obviously utilized in a compressor of air, water, oil, and the like.

Other embodiments of the invention employing the same or equivalent principles may be made by those skilled in the art without departing from the present invention.

What is claimed is:

1. A positive cam type compressor comprising a cylinder having opposite ends, valve plates at each of the ends of the cylinder, front and rear plate casings on said valve plates defining respective compartments, a positive cam mounted in said cylinder to form chambers on opposite sides of the cam, means for rotating said cam, said valve plates having suction and exhaust valve openings for respective feed and discharge of fluid to and from said chambers, at least one isolator plate slidably supported by said cylinder, plate casings, and valve plates, said cam being slidably engaged with said isolator plate to produce successive suction and compression stages in said chambers and reciprocal movement of said plate into and out of said compartments as said cam undergoes rotation, a tank for lubricating fluid, said plate casings having small holes in opposite end walls thereof communicating with said tank, said isolator plate being provided with a network of lubricating channels which open at the surface of the isolator plate for facing regions to be lubricated, said isolator plate having opposite ends with small ports thereat leading to said network of channels, said ports facing said end walls of the plate casings for conveying lubricating fluid to and from said network as the isolator plate undergoes reciprocal movement, wherein said isolator plate constitutes a piston which penetrates into said compartments respectively and produces pressure therein to force the lubricating fluid into said network via said ports and withdraws from said compartments respectively and produces suction therein producing return of lubricating fluid thereto.

2. A positive cam type compressor as claimed in claim 1 wherein two of said isolator plates are provided and operate in reverse directions of travel.

3. A positive cam type compressor as claimed in claim 1 comprising seal means for sealing the sliding connection of the isolator plate and said cam.

4. A positive cam type compressor as claimed in claim 1 wherein said valve openings in said valve plates are proximate the isolator plate.

5. A positive cam type compressor as claimed in claim 1 comprising seal means for sealing said isolator plate in said plate casings.

* * * * *